US010427282B2

(12) United States Patent
Ishikawa et al.

(10) Patent No.: US 10,427,282 B2
(45) Date of Patent: Oct. 1, 2019

(54) ROTARY IMPACT TOOL AND METHOD FOR CONTROLLING THE SAME

(71) Applicant: MAKITA CORPORATION, Anjo-shi, Aichi (JP)

(72) Inventors: Goshi Ishikawa, Anjo (JP); Yoshihiro Ito, Anjo (JP); Toshihisa Takada, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 566 days.

(21) Appl. No.: 15/236,718

(22) Filed: Aug. 15, 2016

(65) Prior Publication Data

US 2017/0057064 A1 Mar. 2, 2017

(30) Foreign Application Priority Data

Aug. 24, 2015 (JP) ..... 2015-164929

(51) Int. Cl.
*B25B 23/147* (2006.01)
*B25B 21/02* (2006.01)

(52) U.S. Cl.
CPC ..... *B25B 23/1475* (2013.01); *B25B 21/02* (2013.01)

(58) Field of Classification Search
CPC ..... B25B 23/1475; B25B 21/02
USPC ..... 173/90, 5, 176, 179–181
See application file for complete search history.

(56) References Cited

U.S. PATENT DOCUMENTS 7,036,605 B2 * 5/2006 Suzuki ..... B25B 21/02 173/176

FOREIGN PATENT DOCUMENTS

JP H09-285974 A 11/1997
JP 2004-237387 A 8/2004
JP 2009-154226 A 7/2009

OTHER PUBLICATIONS

Dec. 18, 2018 Japanese Office Action issued in Japanese Patent Application No. 2015-164929.

* cited by examiner

*Primary Examiner* — Michelle Lopez
(74) *Attorney, Agent, or Firm* — Oliff PLC

(57) ABSTRACT

In a rotary impact tool according to an aspect of the present disclosure, an impact mechanism rotates an output shaft by a rotational force of a motor and, when a torque equal to or greater than a given value is externally applied to the output shaft in a direction opposite a rotational direction of the output shaft, the impact mechanism intermittently applies an impact force as a momentary torque to the output shaft in the rotational direction of the output shaft. A protection unit stops the motor or reduces a rotational speed of the motor on condition that an abnormal impact detection unit detects the abnormal impact. A control unit controls activation of the protection unit differently when the rotational direction of the motor is set to a reverse rotational direction in comparison with when the rotational direction of the motor is set to a forward rotational direction.

10 Claims, 8 Drawing Sheets

4
M
50
40
U
V
W
42
Q1
Q2
Q3
Q4
Q5
Q6
55
CURRENT DETECTION CIRCUIT
44
GATE CIRCUIT
46
Vcc
CONTROL CIRCUIT
51
CPU
52
ROM
53
RAM
54
ADC
Vcc
REGULATOR
48
FORWARD/REVERSE CHANGEOVER SW
SPEED SELECTOR SW
TRIGGER SW
LIGHTING LED
22
24
21
23
30
29

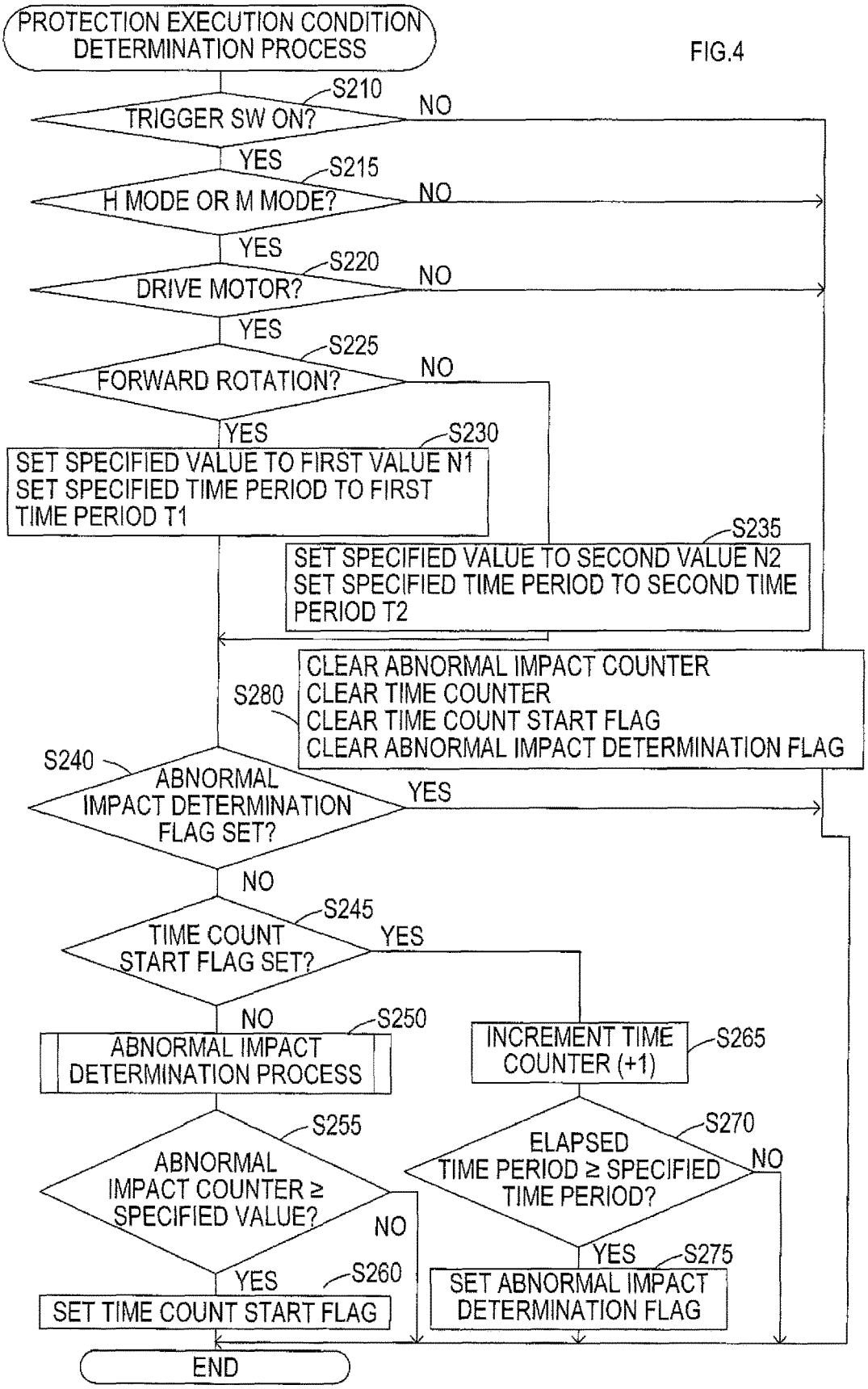
PROTECTION EXECUTION CONDITION DETERMINATION PROCESS
FIG.4
S210
TRIGGER SW ON?
NO
YES
S215
H MODE OR M MODE?
NO
YES
S220
DRIVE MOTOR?
NO
YES
S225
FORWARD ROTATION?
NO
YES
S230
SET SPECIFIED VALUE TO FIRST VALUE N1
SET SPECIFIED TIME PERIOD TO FIRST TIME PERIOD T1
S235
SET SPECIFIED VALUE TO SECOND VALUE N2
SET SPECIFIED TIME PERIOD TO SECOND TIME PERIOD T2
S280
CLEAR ABNORMAL IMPACT COUNTER
CLEAR TIME COUNTER
CLEAR TIME COUNT START FLAG
CLEAR ABNORMAL IMPACT DETERMINATION FLAG
S240
ABNORMAL IMPACT DETERMINATION FLAG SET?
YES
NO
S245
TIME COUNT START FLAG SET?
YES
NO
S250
ABNORMAL IMPACT DETERMINATION PROCESS
INCREMENT TIME COUNTER (+1)
S265
S255
ABNORMAL IMPACT COUNTER ≥ SPECIFIED VALUE?
NO
YES
S260
SET TIME COUNT START FLAG
S270
ELAPSED TIME PERIOD ≥ SPECIFIED TIME PERIOD?
NO
YES
S275
SET ABNORMAL IMPACT DETERMINATION FLAG
END

MOTOR CONTROL PROCESS

S310
TRIGGER SW ON?
NO
YES
S320
DRIVE MOTOR?
NO
YES
S330
H MODE OR M MODE?
YES
NO
S340
ABNORMAL IMPACT DETERMINATION FLAG SET?
YES
NO
S350
OUTPUT SETTING PROCESS
S370
MOTOR STOP PROCESS
S360
MOTOR DRIVE PROCESS
S380
CLEAR OUTPUT VALUE
END

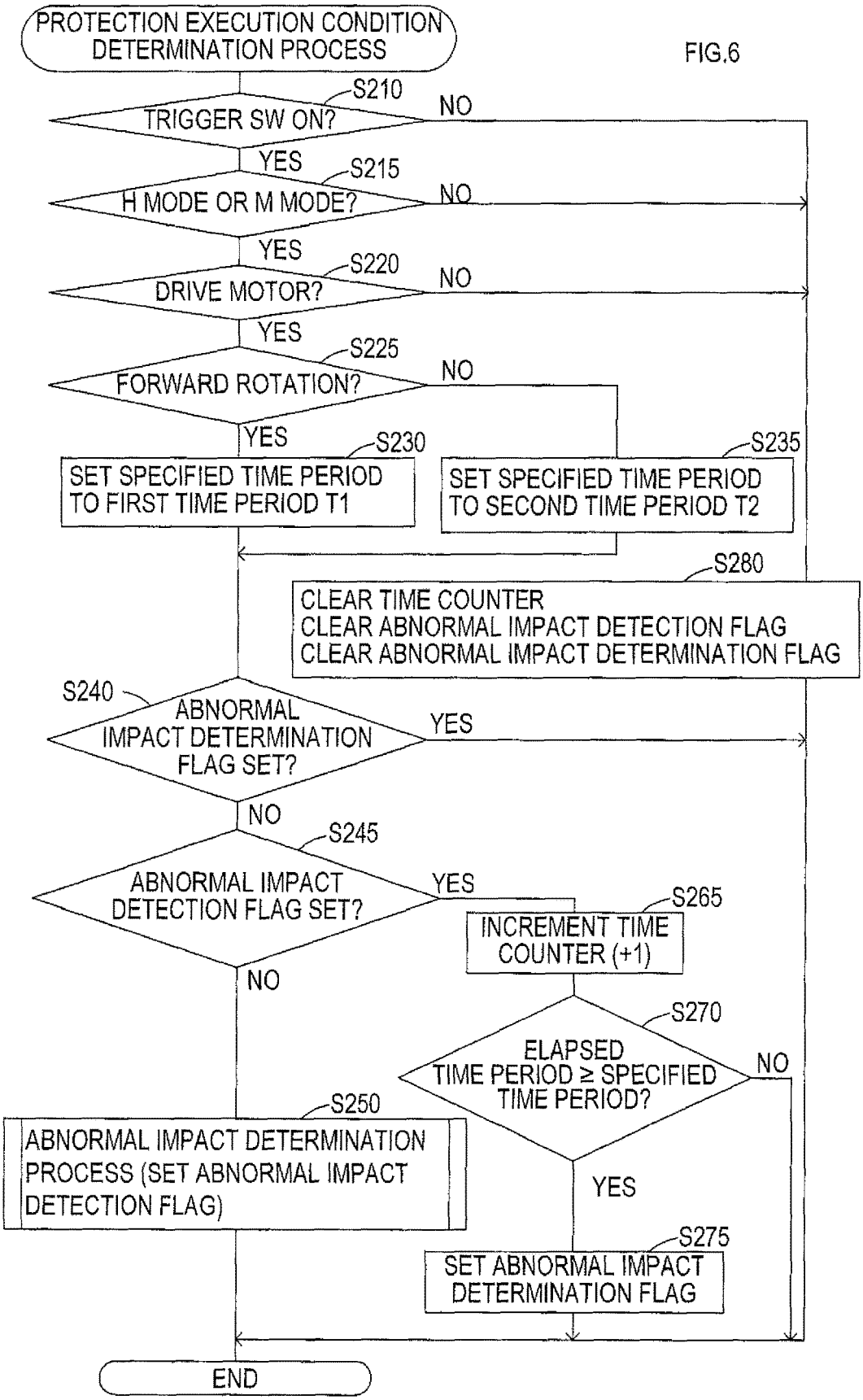
PROTECTION EXECUTION CONDITION DETERMINATION PROCESS
FIG.6
S210
TRIGGER SW ON?
NO
YES
S215
H MODE OR M MODE?
NO
YES
S220
DRIVE MOTOR?
NO
YES
S225
FORWARD ROTATION?
NO
YES
S230
SET SPECIFIED TIME PERIOD TO FIRST TIME PERIOD T1
S235
SET SPECIFIED TIME PERIOD TO SECOND TIME PERIOD T2
S280
CLEAR TIME COUNTER
CLEAR ABNORMAL IMPACT DETECTION FLAG
CLEAR ABNORMAL IMPACT DETERMINATION FLAG
S240
ABNORMAL IMPACT DETERMINATION FLAG SET?
YES
NO
S245
ABNORMAL IMPACT DETECTION FLAG SET?
YES
S265
INCREMENT TIME COUNTER (+1)
NO
S270
ELAPSED TIME PERIOD ≥ SPECIFIED TIME PERIOD?
NO
S250
ABNORMAL IMPACT DETERMINATION PROCESS (SET ABNORMAL IMPACT DETECTION FLAG)
YES
S275
SET ABNORMAL IMPACT DETERMINATION FLAG
END

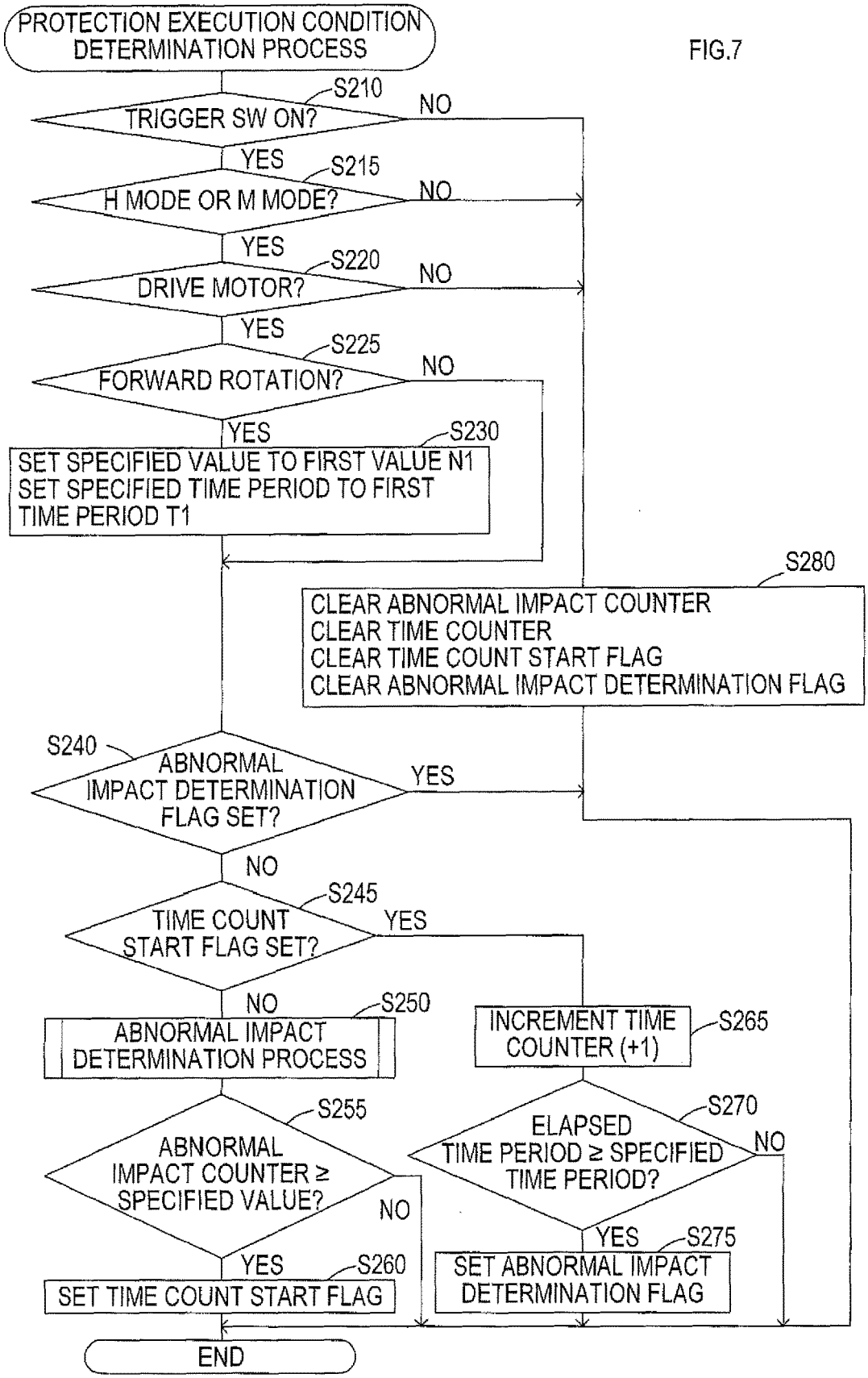
PROTECTION EXECUTION CONDITION DETERMINATION PROCESS
FIG.7
S210
TRIGGER SW ON?
NO
YES
S215
H MODE OR M MODE?
NO
YES
S220
DRIVE MOTOR?
NO
YES
S225
FORWARD ROTATION?
NO
YES
S230
SET SPECIFIED VALUE TO FIRST VALUE N1
SET SPECIFIED TIME PERIOD TO FIRST TIME PERIOD T1
S280
CLEAR ABNORMAL IMPACT COUNTER
CLEAR TIME COUNTER
CLEAR TIME COUNT START FLAG
CLEAR ABNORMAL IMPACT DETERMINATION FLAG
S240
ABNORMAL IMPACT DETERMINATION FLAG SET?
YES
NO
S245
TIME COUNT START FLAG SET?
YES
NO
S250
ABNORMAL IMPACT DETERMINATION PROCESS
INCREMENT TIME COUNTER (+1)
S265
S255
ABNORMAL IMPACT COUNTER ≥ SPECIFIED VALUE?
NO
S270
ELAPSED TIME PERIOD ≥ SPECIFIED TIME PERIOD?
NO
YES
S275
SET ABNORMAL IMPACT DETERMINATION FLAG
YES
S260
SET TIME COUNT START FLAG
END

MOTOR CONTROL PROCESS

S310
TRIGGER SW ON?
NO
YES
S320
DRIVE MOTOR?
NO
YES
S330
H MODE OR M MODE?
YES
NO
S340
ABNORMAL IMPACT DETERMINATION FLAG SET?
YES
NO
S350'
OUTPUT SETTING PROCESS
S350
OUTPUT SETTING PROCESS
S355
CORRECTION TO DECREASE TARGET OUTPUT VALUE
S360
MOTOR DRIVE PROCESS
S360'
MOTOR DRIVE PROCESS
S370
MOTOR STOP PROCESS
S380
CLEAR OUTPUT VALUE
END

ROTARY IMPACT TOOL AND METHOD FOR CONTROLLING THE SAME

CROSS-REFERENCE TO RELATED APPLICATIONS

This application claims the benefit of Japanese Patent Application No. 2015-164929 filed Aug. 24, 2015 in the Japan Patent Office, the disclosure of which is incorporated herein by reference,

BACKGROUND

The present disclosure relates to a rotary impact tool provided with an impact mechanism capable of intermittently applying an impact force as a momentary torque to an output shaft for tightening and loosening screws and a method for controlling such a rotary impact tool.

Rotary impact tools of this type include one that is configured to stop a motor when an impact abnormality is detected (see, for example, Japanese Unexamined Patent Application Publication No. 2009-154226). The impact abnormality is an abnormality in which a reduced tightening torque hinders normal tightening.

SUMMARY

When, for example, a wood screw is tightened into a wood member using a rotary impact tool of this type, the wood screw goes further into the wood member if the impact mechanism applies an impact force to the output shaft after the wood screw fully enters the wood member. In this case, not too much reaction force is considered to be applied from the output shaft to the impact mechanism when the impact force occurs.

In contrast, assume that, when, for example, a mechanical screw is tightened into a mounting hole in a metal member, the impact mechanism applies an impact force to the output shaft after the mechanical screw is fully tightened. In this case, the mechanical screw hardly moves, resulting in a greater reaction force applied from the output shaft to the impact mechanism when the impact force occurs.

This means that the reaction force is small if a material into which a screw is tightened is soft like wood, and the reaction force is large if the material is hard like metal. When the reaction force is excessive, the impact mechanism and other constituent components that make up the rotary impact tool may be damaged. However, the technique disclosed in Japanese Unexamined Patent Application Publication No. 2009-154226 cannot prevent or reduce damage from such an excessive reaction force.

The inventors of the present invention have thus considered detecting, as an abnormal impact, a state in which a reaction force from the output shaft against the impact mechanism is greater than a specified value when an impact force occurs and providing a protective function that stops the motor or reduces a rotational speed of the motor on condition that the abnormal impact is detected. However, if the protective function is configured to be activated in screw loosening on the same condition as in screw tightening, the protective function may be activated in loosening a screw tightened under occurrence of an abnormal impact, thus making the loosening of the screw difficult.

It is desired in a rotary impact tool according to the present disclosure that prevention or reduction of damage from an abnormal impact and operability in loosening a tightened object are both ensured.

A rotary impact tool according an aspect of the present disclosure comprises a motor, an impact mechanism, a rotational direction setting unit, an abnormal impact detection unit, a protection unit, and a control unit.

The impact mechanism includes an output shaft for attachment thereto of a tool element. The impact mechanism rotates the output shaft by a rotational force of the motor and, when a torque equal to or greater than a given value is externally applied to the output shaft in a direction opposite a rotational direction of the output shaft, the impact mechanism intermittently applies an impact force as a momentary torque to the output shaft in the rotational direction of the output shaft.

The rotational direction setting unit is operated by a user of the rotary impact tool to set a rotational direction of the motor either to a forward rotational direction as a direction of tightening an object using the tool element or to a reverse rotational direction as a direction of loosening the tightened object.

The abnormal impact detection unit detects an abnormal impact. The abnormal impact is a state in which a reaction force from the output shaft against the impact mechanism is greater than a specified value when the impact mechanism produces the impact force.

The protection unit stops the motor or reduces a rotational speed of the motor on condition that the abnormal impact detection unit detects the abnormal impact.

The control unit controls activation of the protection unit differently when the rotational direction of the motor is set to the reverse rotational direction (hereinafter referred to as "in the reverse rotation setting") by the rotational direction setting unit in comparison with when the rotational direction of the motor is set to the forward rotational direction (hereinafter referred to as "in the forward rotation setting") by the rotational direction setting unit.

Due to the provided protection unit, such a configuration of rotary impact tool can prevent or reduce damage from an abnormal impact to the impact mechanism and other constituent components.

Further, due to the provided control unit, the activation of the protection unit is controlled differently in loosening a tightened object (i.e., in the reverse rotation setting) in comparison with in tightening the object (i.e., in the forward rotation setting). This facilitates even loosening of an object tightened under occurrence of an abnormal impact. For example, if a condition for activating the protection unit is satisfied by satisfying all of a plurality of conditions, the condition for activating the protection unit can be made more difficult to be satisfied by setting at least one of the plurality of conditions to one that is more difficult to be satisfied. For further example, the condition for activating the protection unit can be made more difficult to be satisfied also by increasing the number of conditions required to satisfy the condition for activating the protection unit.

Thus, the prevention or reduction of damage from an abnormal impact and the operability in loosening a tightened object are both ensured.

Specifically, the control unit may control the protection unit to be activated less readily in the reverse rotation setting in comparison with in the forward rotation setting.

More specifically, the control unit may be configured to control the activation of the protection unit differently in the reverse rotation setting by setting the condition for activating the protection unit (hereinafter referred to as "the protection unit activation condition") to a condition that is more difficult to be satisfied in comparison with in the forward rotation setting.

Such a configuration of rotary impact tool can readily make the activation of the protection unit more difficult or less difficult by changing the protection unit activation condition.

The rotary impact tool may further comprise a count value determination unit. The count value determination unit determines whether a count value corresponding to the number of abnormal impacts detected by the abnormal impact detection unit has reached a specified value. In such a case, the protection unit may be configured to be activated on condition that the count value determination unit determines that the count value has reached the specified value. The control unit may be configured to set the specified value to a greater value in the reverse rotation setting in comparison with in the forward rotation setting. This is because setting the specified value to a greater value (i.e., setting it to a greater number) makes it more difficult to satisfy the protection unit activation condition, thus making the protection unit activated less readily. Thus, increasing the specified value can make it more difficult to satisfy the protection unit activation condition, allowing for a different control of the activation of the protection unit.

The rotary impact tool may further comprise a time determination unit in addition to the count value determination unit. The time determination unit determines whether a specified time period has elapsed since the count value determination unit has determined that the count value has reached the specified value. In such a case, the protection unit may be configured to be activated on condition that the time determination unit determines that the specified time period has elapsed. The control unit may be configured to set also the specified time period to a greater value in the reverse rotation setting in comparison with in the forward rotation setting. This is because setting the specified time period to a greater value (i.e., setting it to a longer period) makes it more difficult to satisfy the protection unit activation condition, thus making the protection unit activated less readily. Thus, increasing the specified value and the specified time period can make it more difficult to satisfy the protection unit activation condition, allowing for a different control of the activation of the protection unit. Such a configuration of rotary impact tool can change difficulty in satisfying the protection unit activation condition in a more detailed manner by changing both the specified value and the specified time period between in the forward rotation setting and in the reverse rotation setting. This is effective in optimizing the difficulty in satisfying the protection unit activation condition.

If the rotary impact tool comprises the count value determination unit and the time determination unit, the protection unit may be configured to be activated on condition that the time determination unit determines that the specified time period has elapsed. In such a case, the control unit may be configured to set the specified time period to a greater value in the reverse rotation setting in comparison with in the forward rotation setting. Setting the specified time period to a greater value makes it more difficult to satisfy the protection unit activation condition, allowing for a different control of the activation of the protection unit.

The rotary impact tool may include an after-detection time determination unit, instead of including the count value determination unit. The after-detection time determination unit determines whether a specified time period has elapsed since the abnormal impact detection unit has detected an abnormal impact. In such a case, the protection unit may be configured to be activated on condition that the after-detection time determination unit determines that the specified time period has elapsed. The control unit may be configured to set the specified time period to a greater value in the reverse rotation setting in comparison with in the forward rotation setting. Setting the specified time period to a greater value makes it more difficult to satisfy the protection unit activation condition, allowing for a different control of the activation of the protection unit.

Alternatively, the control unit may be configured to control the activation of the protection unit in the reverse rotation setting by prohibiting the activation of the protection unit. In other words, the rotary impact tool may be configured not to activate the protection unit in the reverse rotation setting.

In such a case, the control unit may be configured to prohibit activation of the abnormal impact detection unit. Such a configuration of rotary impact tool can eliminate a processing load of detecting an abnormal impact in the revere rotation setting.

Another aspect of the present disclosure relates to a method for controlling a rotary impact tool comprising a motor; an impact mechanism that includes an output shaft for attachment thereto of a tool element and that is configured to rotate the output shaft by a rotational force of the motor and, when a torque equal to or greater than a given value is externally applied to the output shaft in a direction opposite a rotational direction of the output shaft, to intermittently apply an impact force as a momentary torque to the output shaft in the rotational direction of the output shaft; and a rotational direction setting unit that is configured to be operated by a user of the rotary impact tool to set a rotational direction of the motor either to a forward rotational direction as a direction of tightening an object using the tool element or to a reverse rotational direction as a direction of loosening the tightened object.

This method comprises performing a protective operation that stops the motor or reduces a rotational speed of the motor on condition that an abnormal impact is detected that is a state in which a reaction force from the output shaft against the impact mechanism is greater than a specified value when the impact mechanism produces the impact force; and controlling the protective operation differently when the rotational direction of the motor is set to the reverse rotational direction by the rotational direction setting unit in comparison with when the rotational direction of the motor is set to the forward rotational direction by the rotational direction setting unit.

This method prevents or reduces damage from an abnormal impact to the impact mechanism and other constituent components.

Further, the above method controls activation of the protection unit differently in loosening a tightened object (i.e., in the reverse rotation setting) in comparison with in tightening the object (i.e., in the forward rotation setting). This facilitates even loosening of an object tightened under occurrence of an abnormal impact. For example, if a condition for activating the protection unit is satisfied by satisfying all of a plurality of conditions, the condition for activating the protection unit can be made more difficult to be satisfied by setting at least one of the plurality of conditions to a condition that is more difficult to be satisfied. For further example, the condition for activating the protection unit can be made more difficult to be satisfied also by increasing the number of conditions required to satisfy the condition for activating the protection unit.

Thus, the prevention or reduction of damage from an abnormal impact and the operability in loosening a tightened object are both ensured by the above method.

BRIEF DESCRIPTION OF THE DRAWINGS

Exemplary embodiments of the present invention are described below with reference to the accompanying drawings, in which:

FIG. 4 is a flowchart illustrating a protection execution condition determination process according to the embodiment;

FIG. 6 is a flowchart illustrating a protection execution condition determination process according to a modified embodiment;

FIG. 7 is a flowchart illustrating a protection execution condition determination process according to another modified embodiment.

DETAILED DESCRIPTION OF THE PREFERRED EMBODIMENTS

Embodiments herein describe an oil pulse driver as an example of a rotary impact tool.

First Embodiment

Figure 1:
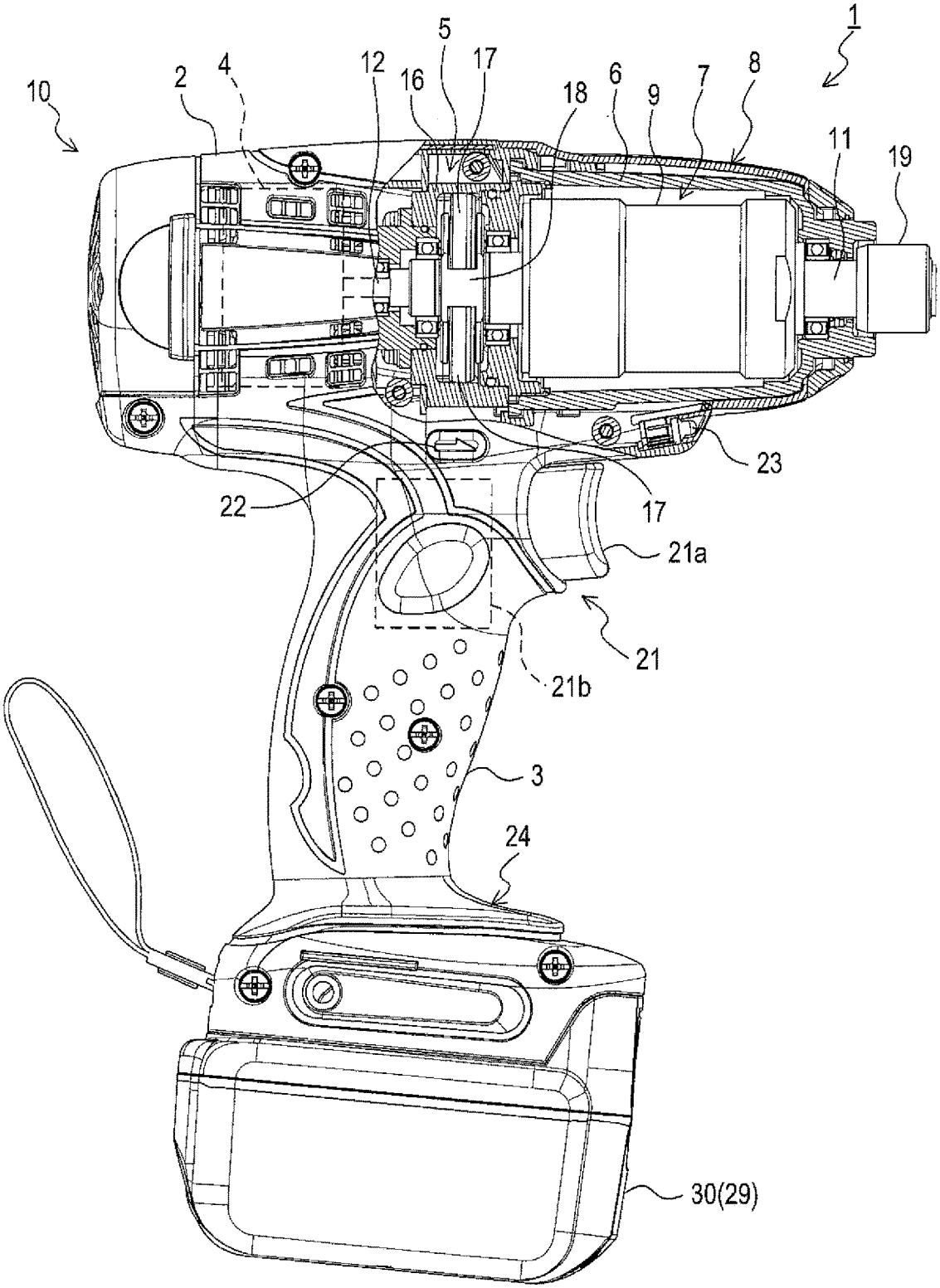
FIG. 1 is a side view illustrating a partially cut-out oil pulse driver according to an embodiment.

As shown in FIG. 1, an oil pulse driver 1 according to an embodiment is a rechargeable oil pulse driver including a tool body 10 and a battery pack 30 supplying electric power to the tool body 10, The tool body 10 comprises a housing 2 accommodating a motor 4 (see FIG. 2) as a power source for the oil pulse driver 1, a speed reduction mechanism 5, etc.; and a grip portion 3 formed to protrude from a lower portion of the housing 2 (on a lower side of FIG. 1).

The housing 2 accommodates the motor 4 and the speed reduction mechanism 5 in this order from a rear side (a left side of FIG. 1) to a front side (a right side of FIG. 1) of the housing 2.

Assembled forward of the speed reduction mechanism 5 (the right side of FIG. 1) in the housing 2 is a cup-shaped unit case 6, which accommodates an oil unit 7 as an impact mechanism. A tubular cover 8 is attached to the unit case 6.

The oil unit 7 comprises a cylindrical case 9 filled with hydraulic oil and a spindle 11 as an output shaft that is pivotally supported by the case 9 and that protrudes from a side of the case 9 opposite the speed reduction mechanism 5.

The case 9 is rotated by a rotational force of the motor 4 via the speed reduction mechanism 5. In the oil unit 7, the case 9 and the spindle 11 are normally rotated integrally with each other. However, if a load to the spindle 11 becomes equal to or greater than a given value, the case 9 and the spindle 11 are rotated relative to each other. In other words, the spindle 11 falls behind with respect to rotation of the case 9. The load to the spindle 11 is a torque externally applied to the spindle 11 in a direction opposite a rotational direction of the spindle 11.

In the oil unit 7, when the case 9 and the spindle 11 are rotated relative to each other, a pressure in an oil chamber inside the case 9 is increased. The case 9 utilizes the increased oil pressure to intermittently apply an impact force to the spindle 11 in the rotational direction of the spindle 11. The impact force is a momentary torque also referred to as an impact. Such an oil unit 7 is disclosed in, for example, Japanese Unexamined Patent Application Publication No. 2006-289596, Japanese Unexamined Patent Application Publication No. 2005-219139, and Japanese Unexamined Patent Application Publication No. 2002-59371. The disclosures of these publications are incorporated herein by reference.

The speed reduction mechanism 5 comprises a gear housing 16 formed with internal gear teeth, a plurality (two in this embodiment) of epicyclic gears 17, 17 capable of revolving around an output shaft (hereinafter referred to as "the motor output shaft") 12 of the motor 4 in the gear housing 16 and a tubular carrier 18 supporting the epicyclic gears 17, 17. The carrier 18 is pivotally supported coaxially with the motor output shaft 12.

The speed reduction mechanism 5 is configured to decelerate rotation of the motor output shaft 12 and to output the decelerated rotation to the carrier 18. A front end of the carrier 18 (i.e., an end thereof facing toward the oil unit 7) and a rear end of the case 9 (i.e., an end thereof facing toward the carrier 18) arranged in the oil unit 7 are coupled to each other. Thus, the case 9 is rotated by the rotational force of the motor 4 via the speed reduction mechanism 5. The motor output shaft 12 and the oil unit 7 are arranged to be coaxial with each other.

Provided at a leading end of the spindle 11 protruding from the case 9 arranged in the oil unit 7 is a chuck sleeve 19 for attachment thereto of various types of tool bits (not shown) such as a driver bit and a socket bit as a tool element.

In the oil pulse driver 1, when the case 9 in the oil unit 7 is rotated by the rotational force of the motor 4 via the speed reduction mechanism 5, the spindle 11 is also rotated along with the case 9.

This leads to rotation of a driver bit or the like attached to the leading end of the spindle 11, thus enabling screw tightening. When the screw tightening proceeds to externally apply a torque equal to or greater than a given value to the spindle 11 in the direction opposite the rotational direction of the spindle 11, the case 9 in the oil unit 7 intermittently applies an impact force to the spindle 11 in the rotational direction of the spindle 11. This impact force enables screw tightening with high torque.

The grip portion 3 is a portion to be gripped by an operator who uses the oil pulse driver 1, above which a trigger switch 21 is provided.

The trigger switch 21 comprises a trigger 21*a* to be pulled by a user of the oil pulse driver 1 and a switch body 21*b* configured to be turned on and off by presence/absence of a pull operation of the trigger 21*a* and also to have a resistance value that is variable according to an operation amount (a pulled amount) of the trigger 21*a*. In the description hereinafter, that the trigger switch 21 is on means that the switch body 21*b* is on by the pull operation of the trigger 21*a*, and that the trigger switch 21 is off means that the switch body 21*b* is off because the pull operation of the trigger 21*a* is not performed.

Provided above the trigger switch 21 (at a lower end of the housing 2) is a forward/reverse changeover switch 22 to be operated by a user to set the rotational direction of the motor 4 either to a forward rotational direction or to a reverse rotational direction. In this embodiment, the forward rotational direction is a clockwise rotational direction seen frontward from a rear end of the oil pulse driver 1, which is a screw tightening direction and the reverse rotational direction is a rotational direction opposite the forward rotational direction, which is a screw loosening direction.

Provided at a lower front of the housing 2 is a lighting LED 23 for lighting forward of the oil pulse driver 1 when the trigger 21*a* is pulled.

Provided at a lower front of the grip portion 3 is a speed selector switch 24 (see FIG. 2) to be operated by a user to set an operation mode of the oil pulse driver 1 to any one of three of a high-speed mode, a middle-speed mode, and a low-speed mode. The rotational speed of the motor 4 increases in the order from the low-speed mode through the middle-speed mode to the high-speed mode, Attached detachably to a lower end of the grip portion 3 is a battery pack 30 accommodating a battery 29. The battery pack 30 is slid from a front toward a rear of the lower end of the grip portion 3 when attached to the lower end of the grip portion 3. In this embodiment, the battery 29 accommodated in the battery pack 30 is a rechargeable battery such as a lithium-ion battery.

In this embodiment, the motor 4 is a three-phase brushless motor including armature windings of U, V, and W phases.

The motor 4 is provided with a rotation sensor 50 (see FIG. 2) for detecting a rotational position (angle) of the motor 4. The rotation sensor 50 comprises, for example, three Hall elements arranged correspondingly to the individual phases of the motor 4 and is configured with a Hall IC configured to generate a rotation detection signal at every given rotational angle of the motor 4, etc.

Provided inside the grip portion 3 is a motor drive device 40 (see FIG. 2) that controls driving of the motor by electric power supplied from the battery 29.

Figure 2:
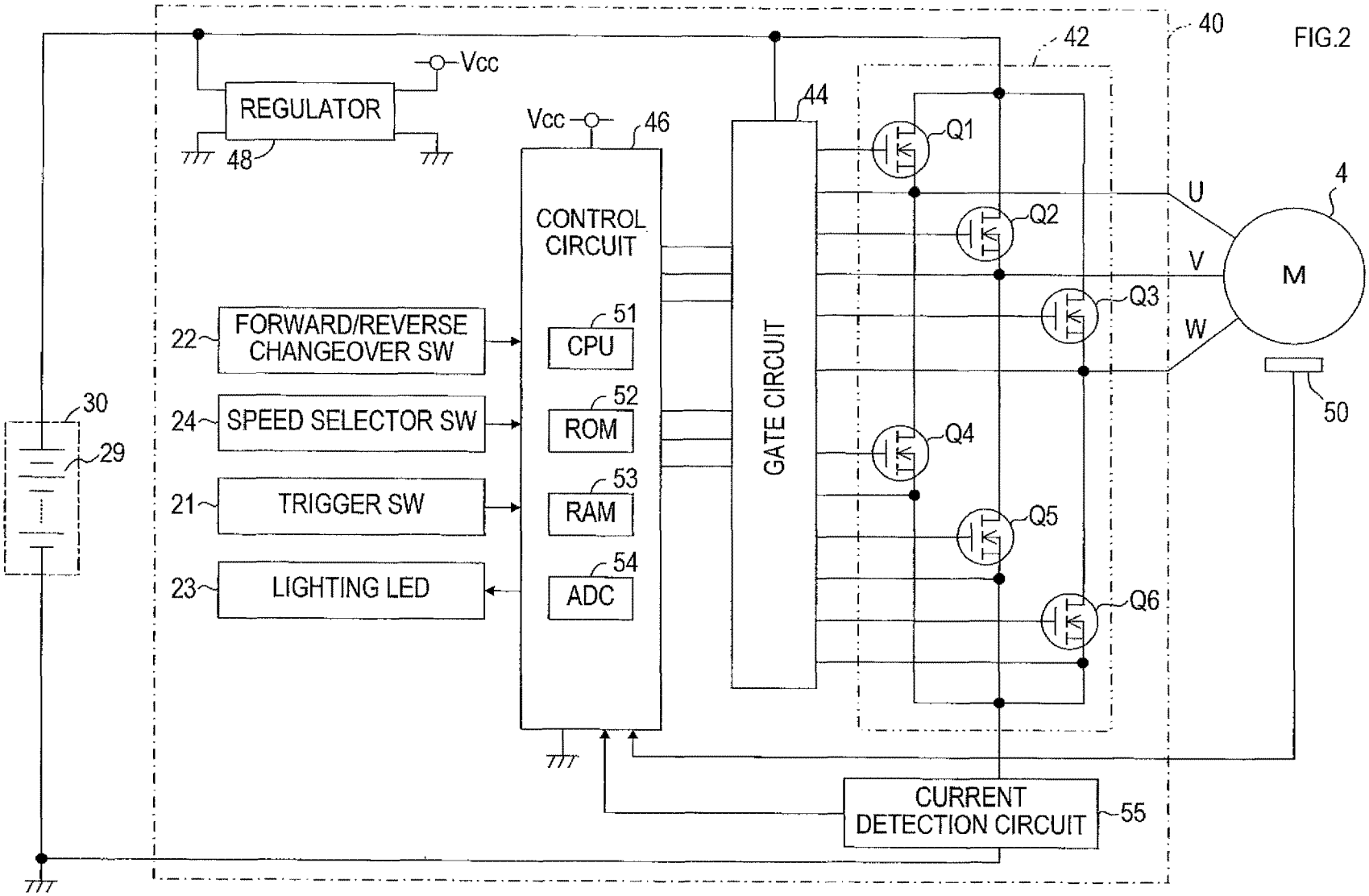
FIG. 2 is a block diagram illustrating an electrical configuration of a motor drive device according to the embodiment.

As shown in FIG. 2, the motor drive device 40 comprises a drive circuit 42, a gate circuit 44, a control circuit 46 using a microcomputer that controls operation of the oil pulse driver 1, and a regulator 48.

The drive circuit 42 causes a current to flow in the windings of the phases of the motor 4 by the electric power supplied from the battery 29. In this embodiment, the drive circuit 42 is configured as a three-phase full-bridge circuit including six switching elements Q1 to Q6. The switching elements Q1 to Q6 are each a MOSFET in this embodiment.

In the drive circuit 42, three switching elements Q1 to Q3 are provided, as so-called high-side switches, between the individual terminals U, V, and W of the motor 4 and a power supply line coupled to a positive pole of the battery 29.

The remaining three switching elements Q4 to Q6 are provided, as so-called low-side switches, between the individual terminals U, V, and W of the motor 4 and a ground line coupled to a negative pole of the battery 29.

The gate circuit 44 turns on and off the switching elements Q1 to Q6 in the drive circuit 42 according to corresponding control signals outputted from the control circuit 46, thus causing a current to flow in the corresponding windings of the phases of the motor 4 to rotate the motor 4.

The control circuit 46 comprises a CPU 51, a ROM 52, a RAM 53, and an A/D converter (ADC) 54. The trigger switch 21 (specifically, the switch body 21*b*), the forward/reverse changeover switch 22, the lighting LED 23, and the speed selector switch 24, described above, are coupled to the control circuit 46. The control circuit 46 receives input of a switch signal indicating presence/absence of the pull operation of the trigger 21*a* (i.e., on/off of the trigger switch 21) and of an operation amount signal indicating the operation amount of the trigger 21*a* as a voltage from the trigger switch 21.

Provided to a current conduction path leading from the drive circuit 42 to the negative pole of the battery 29 in the motor drive device 40 is a current detection circuit 55 for detecting a current (hereinafter referred to as "a motor current") flowing in the motor 4. The current detection circuit 55 comprises, for example, a resistor for current detection and an output circuit that amplifies a voltage between both ends of the resistor to output the amplified voltage as a current detection signal indicating a motor current.

The control circuit 46 also receives input of a current detection signal from the current detection circuit 55 and of a rotation detection signal from the rotation sensor 50.

When the trigger 21*a* is pulled, the control circuit 46 obtains the rotational position and the rotational speed of the motor 4 based on the rotation detection signal from the rotation sensor 50 and drives the motor 4, according to a rotational direction setting signal from the forward/reverse changeover switch 22, in a rotational direction indicated by the rotational direction setting signal. Thus, if the rotational direction set by the forward/reverse changeover switch 22 is the forward rotational direction, the motor 4 is driven in the forward rotational direction; if the rotational direction set by the forward/reverse changeover switch 22 is the reverse rotational direction, the motor 4 is driven in the reverse rotational direction.

In driving the motor 4, the control circuit 46 sets a speed command value for the motor 4 according to the operation amount of the trigger 21*a* and the operation mode set via the speed selector switch 24. The control circuit 46 then sets a drive duty ratio for the switching elements Q1 to Q6 according to the speed command value and outputs control signals (PWM signals) according to the drive duty ratio to the gate circuit 44, thus controlling the rotational speed of the motor 4.

Further, the control circuit 46 performs a control that lights up the lighting LED 23 while the motor is driven, in addition to the drive control for driving the motor 4.

The regulator 48 generates, by the electric power supplied from the battery 29, a given power supply voltage Vcc (for example, DC 5V) required to operate the control circuit 46. The control circuit 46 is operated by the power supply voltage Vcc supplied from the regulator 48.

Figure 3:
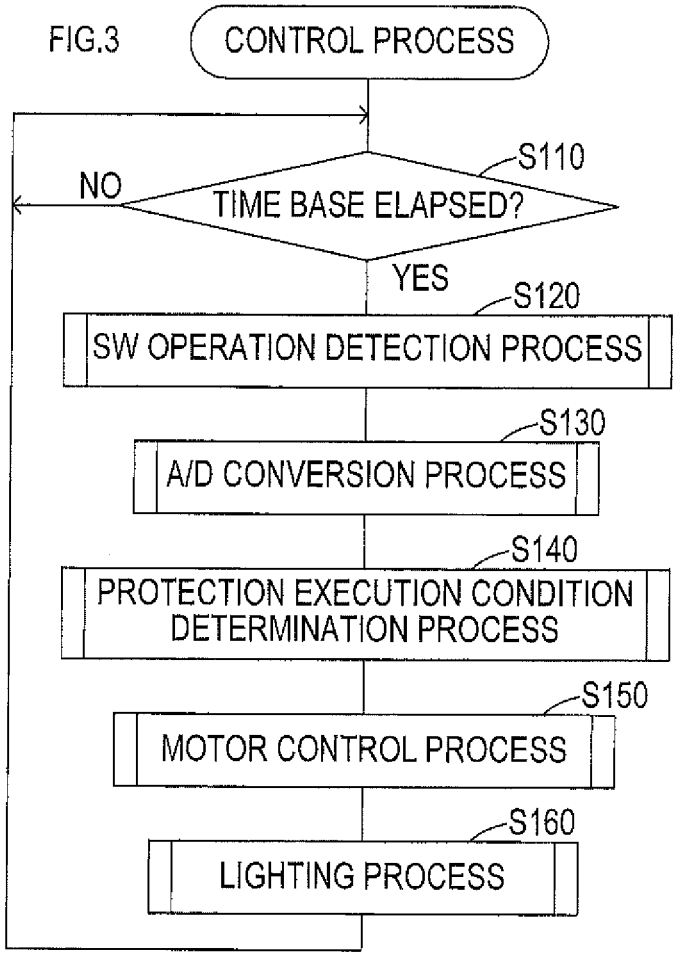
FIG. 3 is a flowchart illustrating a control process according to the embodiment.

A control process performed by the control circuit 46 is described next. The CPU 51's execution of a program stored in the ROM 52 enables processing operation of the control circuit 46, As shown in FIG. 3, the control circuit 46 repeatedly performs a series of processes S120-S160 (S refers to "Step") at a given control cycle.

Specifically, in S110, the control circuit 46 determines whether a time base, which is a given period of time corresponding to the control cycle, has elapsed. If, in S110, the control circuit 46 determines that the time base has elapsed, the process proceeds to S120.

In S120, a switch operation detection process is executed that detects operations of the trigger switch 21, the forward/reverse changeover switch 22, and the speed selector switch 24 by checking respective signal inputs from these switches 21, 22, and 24, In S130, an A/D conversion process is executed that performs A/D conversion to take in an operation amount signal from the trigger switch 21, a detection signal from the current detection circuit 55, and other signals. A/D converting the operation amount signal from the trigger switch 21 allows for detection of the operation amount of the trigger 21*a*.

In S140, a protection execution condition determination process is executed for determining whether a protection execution condition is satisfied. The protection execution condition is a condition that activates a protective function for protecting the oil pulse driver 1 from an abnormal impact and that corresponds to a protection unit activation condition. The abnormal impact is a state in which a reaction force from the spindle 11 as an output shaft against the impact mechanism (the oil unit 7 in this embodiment) is greater than a specified value when the impact mechanism produces an impact force.

In S150, a motor control process is executed that controls the driving of the motor 4 based on the operation amount of the trigger 21*a*, the operation mode set via the speed selector switch 24, the rotational direction of the motor 4 set via the forward/reverse changeover switch 22, the rotational speed of the motor 4, and a determination result of the protection execution condition determination process. The control circuit 46 measures an interval of generation of pulsed rotation detection signals outputted from the rotation sensor 50, to calculate, from the measured value, the rotational speed of the motor 4 (hereinafter also referred to as "the motor rotational speed").

In S160, a lighting process is executed that controls the lighting of the lighting LED 23, and then the process proceeds to S110.

The protection execution condition determination process executed in S140 is described next.

As shown in FIG. 4, the control circuit 46 having started the protection execution condition determination process determines, in S 210, whether the trigger switch 21 is in an on-state. If the trigger switch 21 is in the on-state (i.e., if the trigger 21*a* is pulled), the process proceeds to S215.

In S215, it is determined whether the operation mode set via the speed selector switch 24 is either the high-speed mode (H mode) or the middle-speed mode (M mode). If the operation mode is either the high-speed mode or the middle-speed mode, the process proceeds to S220.

In S220, it is determined whether to drive the motor 4 from the operation amount of the trigger 21*a*, etc. If it is determined not to drive the motor 4, the process proceeds to S280. If it is determined, in S210, that the trigger switch 21 is not in the on-state (i.e., that the trigger 21*a* is not pulled) or if it is determined, in S215, that the operation mode is neither the high-speed mode nor the middle-speed mode (i.e., that the operation mode is the low-speed mode), the process also proceeds to S280.

In S280, an abnormal impact counter, a time counter, a time count start flag, and an abnormal impact determination flag, described later, are cleared, and then the protection execution condition determination process is terminated.

If, on the contrary, it is determined in S220 to drive the motor 4, the process proceeds to S225.

In S225, it is determined whether the rotational direction (hereinafter also referred to as "the set rotational direction") of motor 4 set via the forward/reverse changeover switch 22 is the forward rotational direction. If the set rotational direction is the forward rotational direction, the process proceeds to S230.

In S230, a specified value used in determination performed in S255 described later is set to a first value N1 and a specified time period used in determination performed in S270 described later is set to a first time period T1. The process then proceeds to S240.

In this embodiment, the first value N1 is a value equal to or greater than 1; the first time period T1 is a value greater than 0.

If, in S225, the set rotational direction is not determined to be the forward rotational direction (i.e., determined to be the reverse rotational direction), the process proceeds to S235.

In S235, the specified value used in determination performed in S255 described later is set to a second value N2 and the specified time period used in determination performed in S270 described later is set to a second time period T2. The process then proceeds to S240.

In this embodiment, the second value N2 is a value greater than the first value N1; the second time period T2 is a value greater (in other words, a longer time period) than the first time period T1.

In S240, it is determined whether the abnormal impact determination flag is set. If the abnormal impact determination flag is set, the protection execution condition determination process is directly terminated. The abnormal impact determination flag is a flag indicating whether the protection execution condition is satisfied, which is set in S275 described later.

If, in 240, it is determined that the abnormal impact determination flag is not set, the process proceeds to S245, in which it is determined whether the time count start flag is set. The time count start flag is a flag set in S260 described later, If, in S245, it is determined that the time count start flag is not set, the process proceeds to S250, in which an abnormal impact determination process is executed.

In the abnormal impact determination process, the control circuit 46 detects an abnormal impact and increments the abnormal impact counter each time it detects an abnormal impact. A value of the abnormal impact counter thus indicates the number of abnormal impacts detected. The value of the abnormal impact counter corresponds to an example of a count value corresponding to the number of abnormal impacts detected. In the abnormal impact determination process, the control circuit 46 detects an abnormal impact, for example, as described below.

When the oil unit 7 produces an impact force, the motor rotational speed detected based on a rotation detection signal from the rotation sensor 50 is pulsated. This allows for detection of occurrence of the impact force based on a change in the motor rotational speed. If, for example, a fluctuation width of the motor rotational speed (in particular, a difference between a maximum value and a minimum value appearing in succession of time) is equal to or greater than a threshold value for determining the occurrence of an impact force, it may be determined that the oil unit 7 has produced an impact force. The pulsation of the motor rotational speed at the time of the occurrence of an impact force and the technique of detecting the occurrence of an impact force based on the fluctuation width of the motor rotational speed are disclosed, for example, in Japanese Unexamined Patent Application Publication No. 2013-111729. The disclosures of this publication and U.S. Patent Application Publication No. 2013/0133911A1 are incorporated herein by reference.

The control circuit 46 may thus be configured to determine whether an impact force has occurred from the fluctuation width of the motor rotational speed and to further determine that an abnormal impact has occurred if the fluctuation width of the motor rotational speed at the time of determination of the occurrence of the impact force is equal to or greater than a determination value for detecting an abnormal impact that is greater than the above threshold value. The control circuit 46 may be configured to determine that an abnormal impact has occurred without determining the occurrence of an impact force if the fluctuation width of the motor rotational speed is equal to or greater than the determination value for detecting an abnormal impact. The control circuit 46 may also be configured to determine that an abnormal impact has occurred if a differential value of the motor rotational speed (i.e., a rotational acceleration rate) is equal to or greater than a given determination value.

Since the motor current also fluctuates when an impact force occurs, the control circuit 46 may be configured to detect an abnormal impact based on a fluctuation width of the motor current detected using a current detection signal from the current detection circuit 55, in place of the fluctuation width or the differential value of the motor rotational speed. For example, it may be configured to determine that an abnormal impact has occurred if the fluctuation width of the motor current is equal to or greater than a determination value for detecting an abnormal impact.

The control circuit 46 may also be configured to determine that an abnormal impact has occurred if the fluctuation width of the motor rotational speed is equal to or greater than the given determination value and also the fluctuation width of the motor current is equal to or greater than the given determination value.

The control circuit 46 may also be configured to determine that an abnormal impact has occurred if magnitude of a vibration detected by a vibration sensor (acceleration sensor) provided in the oil pulse driver 1 is equal to or greater than a determination value, at or above which a vibration is regarded as an abnormal impact.

On completion of the abnormal impact determination process of S250, the control circuit 46 proceeds to S255, in which it determines whether the value of the abnormal impact counter is equal to or greater than the specified value set in S230 or S235. If it is determined that the value of the abnormal impact counter is not equal to or greater than the specified value, the protection execution condition determination process is directly terminated.

If, in S255, it is determined that the value of the abnormal impact counter is equal to or greater than the specified value, the process proceeds to S260, in which the time count start flag is set and then the protection execution condition determination process is terminated. Thus, that the time count start flag is set means that the number of abnormal impacts detected has reached the specified value.

If, in S245, it is determined that the time count start flag is set, the process proceeds to S265.

In S265, the time counter is incremented (+1), and then the process proceeds to S270. The time counter is a counter for counting a time period of driving the motor 4 since the setting of the time count start flag in S260, which is a time period having elapsed since the number of abnormal impacts detected has reached the specified value.

In S270, it is determined, based on the value of the time counter, whether the time period having elapsed since the number of abnormal impacts detected has reached the specified value is equal to or greater than the specified time period set in S230 or S235. If the elapsed time period is not equal to or greater than the specified time period, the protection execution condition determination process is directly terminated.

If, in S270, it is determined that the elapsed time period is equal to or greater than the specified time period, the protection execution condition is determined to be satisfied and the process proceeds to S275. In S275, the abnormal impact determination flag is set, and then the protection execution condition determination process is terminated.

The motor control process executed in S150 shown in FIG. 3 is described next.

Figure 5:
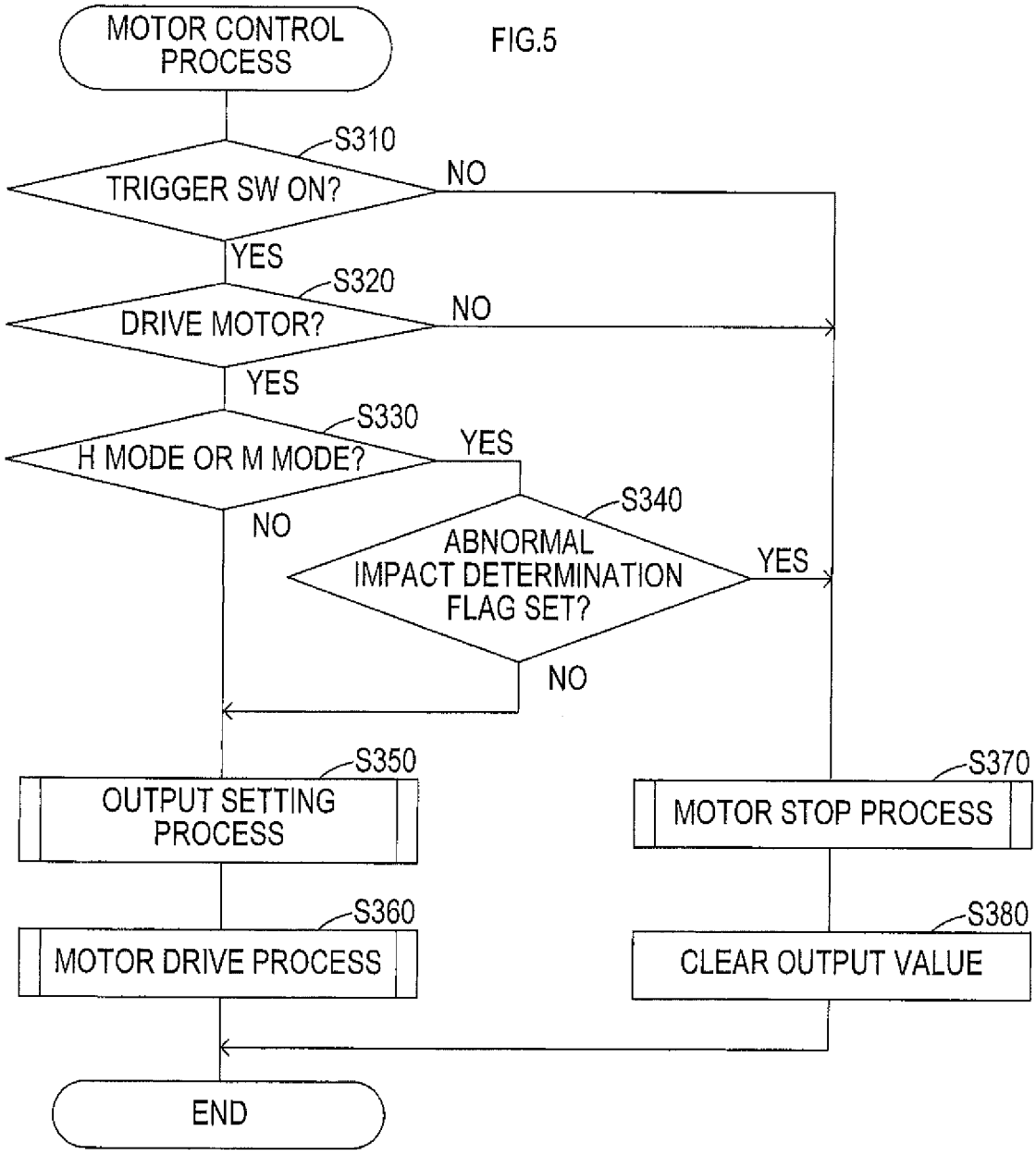
FIG. 5 is a flowchart illustrating a motor control process according to the embodiment.

As shown in FIG. 5, the control circuit 46 having started the motor control process determines in S310 whether the trigger switch 21 is in the on-state. If the trigger switch 21 is in the on-state (i.e., if the trigger 21*a* is pulled), the process proceeds to S320.

In S320, it is determined whether to drive the motor 4 from the operation amount of the trigger 21*a*, etc. If it is determined to drive the motor 4, the process proceeds to S330.

In S330, it is determined whether the operation mode set via the speed selector switch 24 is either the high-speed mode or the middle-speed mode. If the operation mode is either the high-speed mode or the middle-speed mode, the process proceeds to S340.

In S340, it is determined whether the abnormal impact determination flag is set.

If it is determined in S340 that the abnormal impact determination flag is not set, or determined in S330 that the operation mode is neither the high-speed mode nor the middle-speed mode (i.e., the operation mode is the low-speed mode), the process proceeds to S350.

In S350, an output setting process is executed that sets a target output value for driving the motor 4. The target output value is a drive duty ratio that is necessary to control the rotational speed of the motor 4 under no load to a target rotational speed corresponding to the speed command value. In the output setting process of S350, the control circuit 46 calculates a target rotational speed based on the operation amount of the trigger 21*a* and the current operation mode, thus calculating a drive duty ratio corresponding to the target rotational speed as a target output value.

In relation to the operation amount of the trigger 21*a*, the target rotational speed is calculated to be greater as the operation amount is greater. In relation to the operation mode, the target rotational speed is calculated to be greater in the order "from the low-speed mode through the middle-speed mode to the high-speed mode". The target output value is calculated to be greater as the target rotational speed is greater. The target rotational speed and the target output value are calculated using, for example, one or more maps or arithmetic expressions stored in the ROM 52. The control circuit 46 may be configured to directly calculate the target output value from the operation mode and the operation amount of the trigger 21*a* without the step of calculating the target rotational speed.

On terminating the output setting process of S350, the control circuit 46 proceeds to S360, in which it performs a motor drive process. The motor drive process controls the rotational direction and the rotational speed of the motor 4 by setting a drive duty ratio for actually controlling the motor 4 based on the target output value calculated in S350 and the current motor rotational speed, generating control signals based on the set drive duty ratio and the set rotational direction, and outputting the generated control signals to the gate circuit 44. The control circuit 46 having performed the motor drive process terminates the motor control process.

If the control circuit 46 determines in S310 that the trigger switch 21 is not in the on-state or determines in S320 not to drive the motor 4, the process proceeds to S370, in which a motor stop process that stops the motor 4 is executed.

If it is determined in S340 that the abnormal impact determination flag is set, the process also proceeds to S370, in which the motor stop process is executed.

The motor stop process of S370 stops the motor 4 either by generating a braking force on the motor 4 via the drive circuit 42 or by simply cutting off the electric power supply to bring the motor 4 into a free-run state. In S380 to follow, the drive duty ratio is cleared, which is an output value for driving the motor 4 via the drive circuit 42, and then the motor control process is terminated.

Effects Provided by the First Embodiment

When tightening a screw using the oil pulse driver 1 as described above, a user sets the rotational direction of the motor 4 to the forward rotational direction using the forward/reverse changeover switch 22 and pulls the trigger 21*a*. When loosening a tightened screw using the oil pulse driver 1, a user sets the rotational direction of the motor 4 to the reverse rotational direction using the forward/reverse changeover switch 22 and pulls the trigger 21*a*.

In either case of a user tightening or loosening a screw, the detection of an abnormal impact is performed if the operation mode of the oil pulse driver 1 is set to the high-speed mode or the middle-speed mode. Further, when the specified time period used in the determination performed in S270 shown in FIG. 4 has elapsed since the number of abnormal impacts detected has reached the specified value used in the determination performed in S255 shown in FIG. 4, the protection execution condition is satisfied to result in the setting of the abnormal impact determination flag. This activates the protective function that automatically stops the motor 4 even if the trigger 21*a* is pulled. The protective function is enabled if the control circuit 46 determines "YES" in S340 and performs the motor stop process of S370 as shown in FIG. 5. This avoids damage from an abnormal impact to the oil unit 7 as an impact mechanism and other constituent components that make up the oil pulse driver 1.

In a forward rotation setting in which the rotational direction of the motor 4 is the forward rotational direction, the process of S230 shown in FIG. 4 sets the specified value to the first value N1 and also sets the specified time period to the first time period T1. In a reverse rotation setting in which the rotational direction of the motor 4 is the reverse rotational direction, the process of S235 shown in FIG. 4 sets the specified value to the second value N2 and also sets the specified time period to the second time period T2. The second value N2 is a value greater than the first value N1; the second time period T2 is a value greater than the first time period T1.

This makes it more difficult to satisfy the protection execution condition in the reverse rotation setting, thus allowing for a different control of activation of the protective function in comparison with in the forward rotation setting. This means that difficulty in satisfying the protection execution condition varies depending on the specified value and the specified time period. The first embodiment makes it more difficult to satisfy the protection execution condition in the reverse rotation setting by setting both the specified value and the specified time period to greater values, thus allowing for a different control of the activation of the protective function in comparison with in the forward rotation setting.

This avoids a situation in which the protective function is activated very quickly in loosening a screw tightened under occurrence of an abnormal impact, thus making the loosening of the screw difficult. In other words, this facilitates even loosening of a screw tightened under the occurrence of an abnormal impact. Thus, prevention or reduction of damage from an abnormal impact and operability in loosening a tightened screw are both ensured.

The activation of the protection function can readily be made to be more difficult or less difficult by changing the protection execution condition. In addition, the difficulty in satisfying the protection execution condition can be changed in a more detailed manner by changing both the specified value and the specified time period between in the forward rotation setting and in the reverse rotation setting. This is effective in optimizing the difficulty in satisfying the protection execution condition.

In the first embodiment, the forward/reverse changeover switch 22 corresponds to an example of a rotational direction setting unit. The control circuit 46 functions as an abnormal impact detection unit, a protection unit, a control unit, a count value determination unit, and a time determination unit. In the protection execution condition determination process shown in FIG. 4, the process of S250 corresponds to an example of a process performed by the abnormal impact detection unit; the process of S255 corresponds to an example of a process performed by the count value determination unit; the processes of S265 and S270 correspond to examples of processes performed by the time determination unit; the processes of S225-S235 correspond to examples of processes performed by the control unit. In the motor control process shown in FIG. 5, the process of S370 executed if the determination is "YES" in S340 corresponds to an example of a process performed by the protection unit.

Second Embodiment as a Modified First Embodiment

The first time period T1 and the second time period T2 may be set to the same value greater than 0. Thus, it may be configured to set only the specified value to a greater value in the reverse rotation setting in comparison with in the forward rotation setting while the specified time period is the same for both settings.

Such a configuration also can make it more difficult to satisfy the protection execution condition in the reverse rotation setting by setting the specified value to a greater value, thus allowing for a different control of activation of the protective function in comparison with in the forward rotation setting.

Third Embodiment as a Modified First Embodiment

The first time period T1 and the second time period T2 may both be 0.

In such a case, the process determining whether the specified time period has elapsed may not be executed. This allows the protection execution condition determination process shown in FIG. 4 to be modified, for example, as the following (a) to (e).

(a) S245 and S265-S275 are omitted.

(b) If the determination is "NO" in S240, the process proceeds directly to S250.

(c) In S260, which follows S255 if the determination is "YES" in S255, the abnormal impact determination flag is set, instead of the time count start flag.

(d) In each of S230 and S235, the process setting the specified time period is not executed.

(e) In S280, the time counter and the time count start flag is not cleared.

Such a configuration also can make it more difficult to satisfy the protection execution condition in the reverse rotation setting by increasing the specified value, thus allowing for a different control of activation of the protective function in comparison with in the forward rotation setting.

Fourth Embodiment as a Modified First Embodiment

The first value N1 and the second value N2 may be set to the same value greater than 1. Thus, it may be configured to set only the specified time period to a greater value in the reverse rotation setting in comparison with in the forward rotation setting while the specified value is the same for both settings.

Such a configuration also can make it more difficult to satisfy the protection execution condition in the reverse rotation setting by setting the specified time period to a greater value (i.e., making the specified time period longer), thus allowing for a different control of activation of the protective function in comparison with in the forward rotation setting,

Fifth Embodiment as a Modified First Embodiment

The first value N1 and the second value N2 may both be 1.

In such a case, the process determining the number of abnormal impacts detected may not be executed. This allows the protection execution condition determination process shown in FIG. 4 to be modified, for example, as the following (A) to (E).

(A) S255 and S260 are omitted.

(B) In S250, if an abnormal impact is detected, the abnormal impact detection flag is set that indicates that an abnormal impact has been detected.

(C) In S245, it is determined whether the abnormal impact detection flag is set in place of the time count start flag.

(D) In each of S230 and S235, the process setting the specified value is not executed.

(E) In S280, the abnormal impact counter and the time count start flag is not cleared. Instead, the abnormal impact detection flag is cleared.

Such a configuration also can make it more difficult to satisfy the protection execution condition in the reverse rotation setting by making the specified time period longer, thus allowing for a different control of activation of the protective function in comparison with in the forward rotation setting. A protection execution condition determination process according to the fifth embodiment reflecting the above-described modification is shown in FIG. 6.

In the fifth embodiment, the control circuit 46 functions also as an after-detection time determination unit. The processes of S265 and S270 shown in FIG. 6 correspond to examples of processes performed by the after-detection time determination unit.

Sixth Embodiment

An oil pulse driver according to the sixth embodiment is described next, in which the same numeral "1" as used in the first embodiment is used as the numeral for the oil pulse driver. Also, the same numerals as used in the first embodiment are used for constituent components and processes that are similar to those of the first embodiment. Differences from the first embodiment are described below.

In the oil pulse driver 1 according to the sixth embodiment, the control circuit 46 performs the protection execution condition determination process shown in FIG. 7 in place of the protection execution condition determination process shown in FIG. 4. The protection execution condition determination process shown in FIG. 7 differs from the protection execution condition determination process shown in FIG. 4 in terms of the following (1) and (2).

(1) S235 is omitted.

(2) If the determination is "NO" in S225, the process proceeds to S280.

In the sixth embodiment, the abnormal impact determination flag is cleared in S280 in the reverse rotation setting, where the determination is "NO" in S225 shown in FIG. 7. Thus, the determination is never "YES" in S340 shown in FIG. 5, prohibiting the activation of the protective function. The control circuit 46 controls the activation of the protective function by executing a process prohibiting the activation of the protective function (a process clearing the abnormal impact determination flag in this embodiment) in the reverse rotation setting.

The oil pulse driver 1 according to the sixth embodiment as described above also allows for a different control of the activation of the protective function in the reverse rotation setting, thus providing a similar effect to those of the above-described embodiments.

In the reverse rotation setting, where the determination is "NO" in S225 shown in FIG. 7, execution of S230-S275 shown in FIG. 7 is prohibited. The prohibited processes include the abnormal impact determination process of S250. Thus, a processing load for detecting an abnormal impact is eliminated in the reverse rotation setting.

In the protection execution condition determination process shown in FIG. 7, the process clearing the abnormal impact determination flag in S280, which follows S225 if the determination is "NO" in S225, corresponds to an example of a process performed by the control unit.

Other Embodiments

Figure 8:
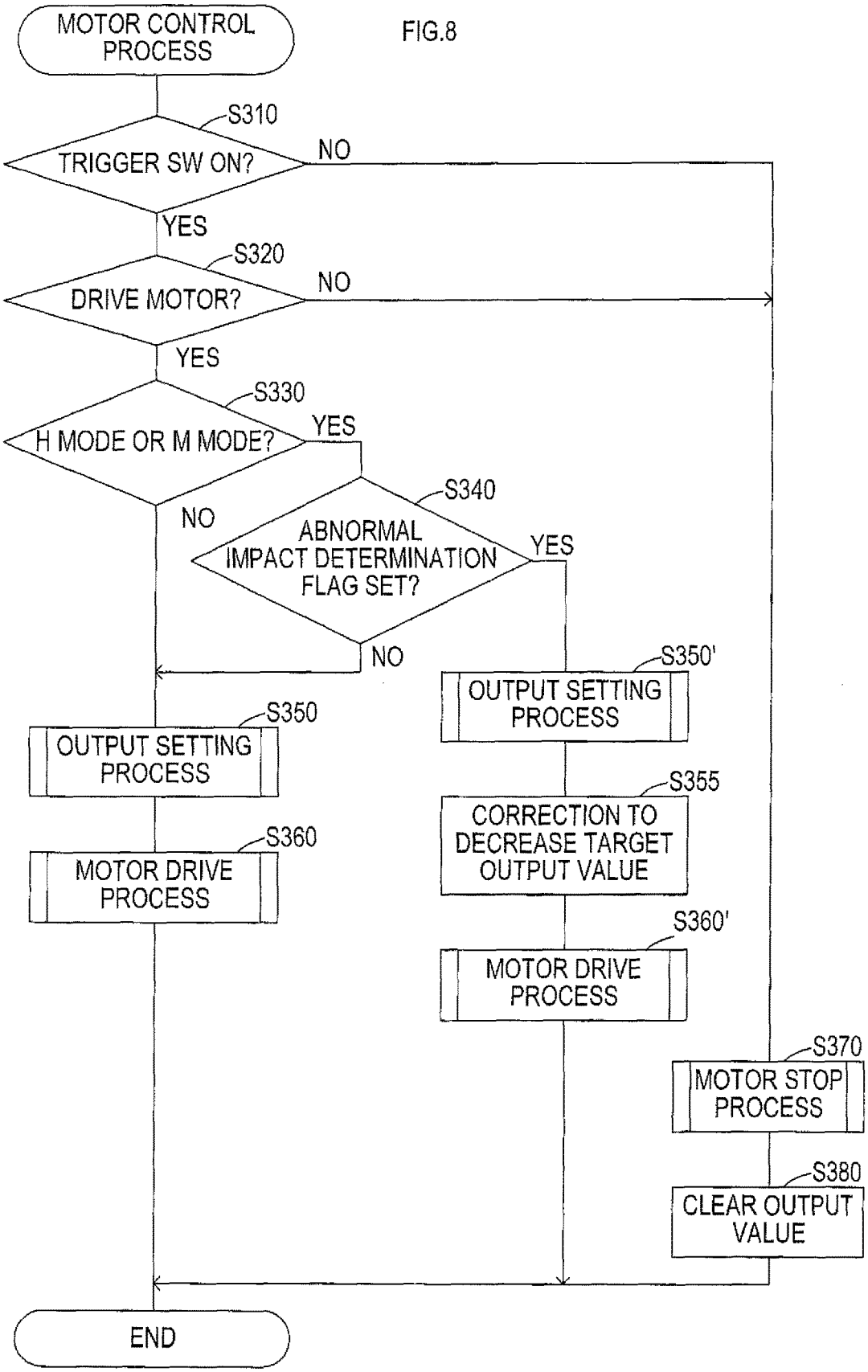
FIG. 8 is a flowchart illustrating another motor control process.

In the above-described embodiments, the motor control process shown in FIG. 5 may be modified as below. A modified motor control process is shown in FIG. 8.

It may be configured to execute a process reducing the rotational speed of the motor 4 instead of proceeding to S370 shown in FIG. 5 if the determination is "YES" (i.e., if the abnormal impact determination flag is determined to be set) in S340. For example, it may be configured to, if the determination is "YES" in S340, execute a process (S350' shown in FIG. 8) similar to the output setting process of S350 shown in FIG. 5 together with a correction (S355 shown in FIG. 8) to decrease the target output value set during the process, which is followed by S360' shown in FIG. 8, in which the motor 4 is driven based on the decreasingly corrected target output value.

Such a configuration also provides a similar effect to those of the above-described embodiments.

In the embodiments other than the sixth embodiment, the determination value used to detect an abnormal impact in the abnormal impact determination process may be set to a greater value in the reverse rotation setting in comparison with in the forward rotation setting. Setting the determination value to a greater value makes it more difficult to detect an abnormal impact in the abnormal impact determination process, thus making it more difficult to satisfy the protection execution condition.

The embodiments of the present invention have been described above, but the present invention should not be limited to the above-described embodiments and can take various forms. The above-mentioned values are merely examples and other values may be used.

For example, the above embodiments have described the three operation modes, but the number of operation modes may be one, two, four, or more.

The above embodiments have described that the detection of an abnormal impact is not performed in the low-speed mode, which rotates the motor 4 at the lowest rotational speed of all the modes. This is because an impact force applied by the oil unit 7 is considered to be too small in the low-speed mode to produce an abnormal impact.

However, if there is a possibility that an abnormal impact may occur even in the low-speed mode, it may be configured to execute processes similar to those performed in the middle-speed mode and the high-speed mode. To be more specific, the processes shown in FIG. 4 and FIG. 7 may be configured to omit S215 and proceed directly to S220 if the determination is "YES" in S210. Further, the process shown in FIG. 5 may be configured to omit S330 and proceed to S340 if the determination is "YES" in S320.

If, for example, no abnormal impact is considered to occur not only in the low-speed mode but also in the middle-speed mode, it may be configured to perform the detection of an abnormal impact only in the high-speed mode. To be more specific, S215 shown in FIG. 4 and FIG. 7 may be configured to determine whether the operation mode is the high-speed mode, and to proceed to S220 if it is the high-speed mode and proceed to S280 if it is not the high-speed mode. Further, S330 shown in FIG. 5 may be configured to determine whether the operation mode is the high-speed mode, and to proceed to S340 if it is the high-speed mode and proceed to S350 if it is not the high-speed mode.

Thus, it may be decided, as appropriate, in which of the operation modes the detection of an abnormal impact is performed to activate the protective function when a plurality of operation modes are provided.

Further, the oil unit 7 as an impact mechanism may be configured to produce an impact force by oil pressure and an impact between metals as disclosed, for example, in Japanese Patent Publication No. 5021240.

The impact mechanism may be configured to produce an impact force by applying an impact on an anvil as an output shaft by a hammer rotated by a motor output as disclosed, for example, in Japanese Unexamined Patent Application Publication No. 2009-154226 and Japanese Unexamined Patent Application Publication No. 2013-111729.

The present invention can be applied not only to oil pulse drivers but also to other rotary impact tools provided with a motor-driven impact mechanism such as, for example, impact drivers and impact wrenches.

The above embodiments have described that the motor 4 comprises a three-phase brushless motor, but it should only be a motor capable of rotationally driving an impact mechanism. For example, the rotary impact tool according to the present invention should not be limited to battery-powered one, and may be supplied with electric power via a cable or may be configured to rotationally drive a tool element by an A/C motor.

The above embodiments have described that the microcomputer is provided as a control circuit 46, but the control circuit may comprise a programmable logic device such as, for example, an application specific integrated circuit (ASIC) or a field programmable gate array (FPGA).

The switching elements Q1-Q6 in the drive circuit 42 may each be a switching element other than a MOSFET such as, for example, a bipolar transistor or an insulated gate bipolar transistor (IGBT).

The above embodiments have described that the battery 29 is a rechargeable lithium-ion battery, but it may be another type of rechargeable battery such as, for example, a nickel-metal hydride rechargeable battery or a nickel cadmium rechargeable battery.

Functions of an element of the above embodiments may be distributed to a plurality of elements, and functions of a plurality of elements may be integrated in an element. Part of the configurations of the above embodiments may be omitted. At least part of the configurations of the above embodiments may be added to or replaced with other configurations of the above embodiments. All modes included in technical ideas defined by the language of the claims are embodiments of the present invention. The present invention may be achieved in various forms such as a program performed by the microcomputer of the above embodiments, a medium on which such a program is recorded, a method for controlling a rotary impact tool, etc.

What is claimed is:

1. A rotary impact tool comprising:

a motor;

an impact mechanism including an output shaft for attachment thereto of a tool element, the impact mechanism being configured to rotate the output shaft by a rotational force of the motor and, when a torque equal to or greater than a given value is externally applied to the output shaft in a direction opposite a rotational direction of the output shaft, to intermittently apply an impact force as a momentary torque to the output shaft in the rotational direction of the output shaft;

a rotational direction setting unit configured to be operated by a user of the rotary impact tool to set a rotational direction of the motor either to a forward rotational direction as a direction of tightening an object using the tool element or to a reverse rotational direction as a direction of loosening the tightened object;

an abnormal impact detection unit configured to detect an abnormal impact, the abnormal impact being a state in which a reaction force from the output shaft against the impact mechanism is greater than a specified value when the impact mechanism produces the impact force;

a protection unit configured to stop the motor or reduce a rotational speed of the motor on a condition that the abnormal impact detection unit detects the abnormal impact;

a control unit configured to control activation of the protection unit differently when the rotational direction of the motor is set to the reverse rotational direction by the rotational direction setting unit in comparison with when the rotational direction of the motor is set to the forward rotational direction by the rotational direction setting unit; and a count value determination unit configured to determine whether a count value corresponding to the number of abnormal impacts detected by the abnormal impact detection unit has reached a specified value, the protection unit being configured to be activated on a condition that the count value determination unit determines that the count value has reached the specified value, and the control unit being configured to set the specified value to a larger value when the rotational direction of the motor is set to the reverse rotational direction in comparison with when the rotational direction of the motor is set to the forward rotational direction.

2. The rotary impact tool according to claim 1, further comprising a time determination unit configured to determine whether a specified time period has elapsed since the count value determination unit has determined that the count value has reached the specified value, wherein the protection unit is configured to be activated on a condition that the time determination unit determines that the specified time period has elapsed, and wherein the control unit is configured to set also the specified time period to a larger value when the rotational direction of the motor is set to the reverse rotational direction in comparison with when the rotational direction of the motor is set to the forward rotational direction.

3. The rotary impact tool according to claim 1, further comprising an after-detection time determination unit configured to determine whether a specified time period has elapsed since the abnormal impact detection unit has detected the abnormal impact, wherein the protection unit is configured to be activated on a condition that the after-detection time determination unit determines that the specified time period has elapsed, and wherein the control unit is configured to set the specified time period to a larger value when the rotational direction of the motor is set to the reverse rotational direction in comparison with when the rotational direction of the motor is set to the forward rotational direction.

4. The rotary impact tool according to claim 1, wherein the control unit is configured to control the activation of the protection unit by prohibiting the activation of the protection unit when the rotational direction of the motor is set to the reverse rotational direction.

5. The rotary impact tool according to claim 4, wherein the control unit is configured to prohibit activation of the abnormal impact detection unit when the rotational direction of the motor is set to the reverse rotational direction.

6. A method for controlling a rotary impact tool according to claim 1, the method comprising:

performing a protective operation that stops the motor or reduces a rotational speed of the motor on a condition that an abnormal impact is detected, the abnormal impact being a state in which a reaction force from the output shaft against the impact mechanism is greater than a specified value when the impact mechanism produces the impact force; and controlling the protective operation differently when the rotational speed of the motor is set to the reverse rotational direction by the rotational direction setting unit in comparison with when the rotational speed of the motor is set to the forward rotational direction by the rotational direction setting unit.

7. A rotary impact tool comprising:

a motor;

a tool holder that engages and retains a tool element;

a gear mechanism that converts output of the motor to a driving force on the tool holder;

a control circuit that controls the motor; and a forward/reverse changeover switch configured to send a signal to the control circuit to have the motor driven in a forward direction or a reverse direction, wherein:

the control circuit is configured to perform a protection execution condition determination process to protect the rotary impact tool and a motor control process for the motor;

the protection execution condition determination process including:

determining whether a rotational direction is set to forward; and performing one of a first setting process when the rotational direction is set to forward and a second setting process when the rotational direction is set to reverse;

the first setting process including:

setting a specified value to a first value (N1); and setting a specified time period to a first time period (T1);

the second setting process including:

setting the specified value to a second value (N2); and setting the specified time period to a second time period (T2);

N2 being greater than N1, and T2 being greater than T1;

the result of the protection execution condition determination process is the setting of values and times for determining when a motor stop process should be initiated due to certain conditions; and the motor control process is conducted based on the result of the protection execution condition determination process.

8. The rotary impact tool according to claim 7, wherein the protection execution condition determination process further includes:

determining that an abnormal impact determination flag is not set;

determining that a time count start flag is not set;

performing an abnormal impact determination process;

determining that an abnormal impact counter is equal to or greater than the specified value; and setting the time count start flag.

9. The rotary impact tool according to claim 7, wherein the protection execution condition determination process further includes:

determining that an abnormal impact determination flag is not set;

determining that a time count start flag is set;

incrementing a time counter;

determining that an elapsed time period is equal to or greater than the specified time period; and setting an abnormal impact determination flag.

10. The rotary impact tool according to claim 9, wherein the motor control process includes:

determining that the abnormal impact determination flag is set; and performing a motor stop process.

* * * * *